US005140726A

United States Patent [19]

Wu et al.

[11] Patent Number: 5,140,726

[45] Date of Patent: Aug. 25, 1992

[54] SAFETY PIN

[76] Inventors: Chao-Fu Wu, No. 71, Hsin Sheng Rd., Tsao Tun Chen; Ju-Sung Chang, No. 4, Lane 48, Min Sheng 3rd Street, both of Nan Tou, Taiwan

[21] Appl. No.: 852,805

[22] Filed: Mar. 17, 1992

[51] Int. Cl.[5] ..... A44B 9/12

[52] U.S. Cl. ..... 24/708.9; 24/708; 24/708.8

[58] Field of Search ..... 24/708.9, 708, 708.8, 24/709.2, 709.7, 707.6, 707.9, 706.2, 706.5, 706.6

[56] References Cited

U.S. PATENT DOCUMENTS

| | | | |
|---|---|---|---|
| 1,373,125 | 3/1921 | Fielding | 24/708 |
| 1,980,124 | 11/1934 | Wells | 24/708 |
| 2,142,877 | 1/1939 | Wells | 24/708 |
| 2,162,820 | 6/1939 | Morehouse | 24/708 |
| 2,383,012 | 8/1945 | Morehouse | 24/708 |
| 4,071,927 | 2/1978 | Bagnasco | 24/709.9 |

*Primary Examiner*—Victor N. Sakran
*Attorney, Agent, or Firm*—Bacon & Thomas

[57] ABSTRACT

A safety pin comprised of a pin having one end pivoted to a pivot bearing at one end of an elongated base plate above a face board, and a pointed opposite end releasably retained to a pin holder at an opposite end of said elongated base plate, wherein said pin holder comprises two side springs for holding the point of said pin, and a front guard for protecting the point of said pin, said side springs having L-shaped pawls releasably retained together for locking up the point of said pin. Squeezing said two side springs inwards causes said L-shaped pawls to move apart for passing the point of said pin; releasing the pressure from said two side springs causes said L-shaped pawls to retain together in locking up the point of said pin.

3 Claims, 2 Drawing Sheets

SAFETY PIN

BACKGROUND OF THE INVENTION

1. Field of the Invention

The present invention relates to safety pins, and more particularly, the present invention relates to a safety pin which has a front guard to protect the point of the pin from piercing the skin when locked.

2. Description of Prior Art

Conventionally, a safety pin is simply a pin bent back on itself so as to form a spring, with a guard or sheath to cover the point. However, this structure of safety pin is still not safe in use because the point may escape from the guard easily when shaken.

FIGS. 4 and 5 illustrate another structure of prior art safety pin which is generally comprised of a base plate (71) supported on a rectangular board (70). The base plate (71) has a rear end formed into a vertical pivot bearing (72) for holding a pin (74) by a pivot pin (73), and a front end formed into a circular seat (75) for supporting the point of the pin (74). The circular seat (75) has a notch (750) on the top edge thereof for passing the pint of the pin (74). There is also provided a guard (80) pivoted to the circular seat (75) for holding the point of the pin (74) in the circular seat (75). The guard (80) comprises a side projection (82) through which the guard (80) can be rotated with the fingers to close or open the notch (750), and two paralleled, circular retaining plates (81) for holding the circular seat (75) therein. A notch (810) is formed on the retaining plates (81) at a location corresponding to the notch (750) on the seat (75). When the notches (750), (810) are aligned, the point of the pin (74) can be moved in or out of the circular seat (75), when the notches (750), (810) are not in alignment, the point of the pin (74) can be retained in the circular seat (75). Further, the rectangular board (70) has a bottom edge for attaching a name plate or advertising matter. However, because the guard (80) is pivoted to the circular seat (75), it may be moved from its locking position easily, causing the notches (750), (810) to be in alignment, and therefore, the point of the pin (74) may escape from the circular seat (75). Further, because the point of the pin (74) projects out of the circular seat (75) (see FIG. 5) when held therein by the guard (80) it may injure an user's fingers easily. Therefore, this structure of safety pin is still not safe in use.

SUMMARY OF THE INVENTION

The present invention has been accomplished under the aforesaid circumstances. It is therefore an object of the preset invention to provide a safety pin which is easy to operate and can firmly retain the pin in place when locked. It is another object of the present invention to provide a safety pin which has means to protect the point of the pin so as to prevent it from piercing the skin when locked.

According to the present invention, there is provided a safety pin which is generally comprised of an enlongated base plate longitudinally supported on a rectangular board. The base plate has a rear end formed into a vertical pivot bearing for pivoting a pin, and a rear end formed into a pin holder for releasably locking up the point of the pin. The pin holder is comprised of two side springs for holding the point of the pin, and a front guard for protecting the point of the pin. The side springs have L-shaped pawls releasably retained together for locking up the point of the pin. Squeezing the two side springs inwards causes the L-shaped pawls to move apart for passing the point of the pin. When the pressure is released from the two side springs, the material property of the side springs causes the L-shaped pawls to return to their original positions in locking up the point of the pin.

BRIEF DESCRIPTION OF THE DRAWINGS

The foregoing and other objects, features and advantages of the present invention will be beat understood from the following description, the appended claims and the accompanying drawings in which:

DETAILED DESCRIPTION OF THE PREFERRED EMBODIMENT

Figure 1:
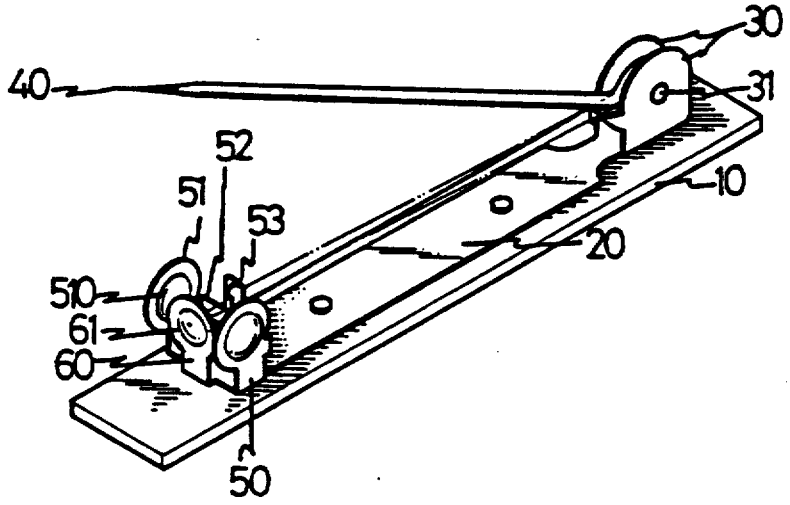
FIG. 1 is an elevational view of a safety pin embodying the present invention.
Figure 4:
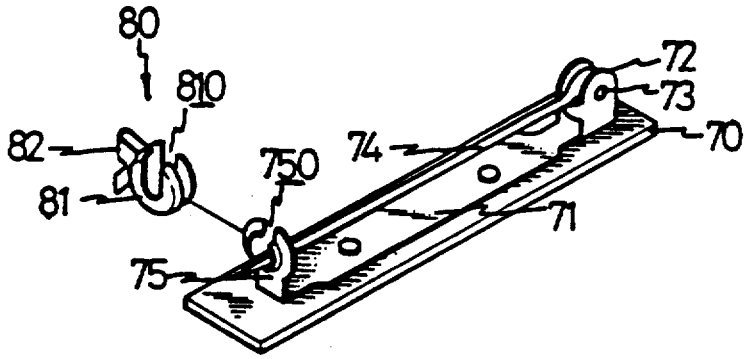
FIG. 4 is an elevational and partly exploded view of a prior art safety pin.
Figure 2:
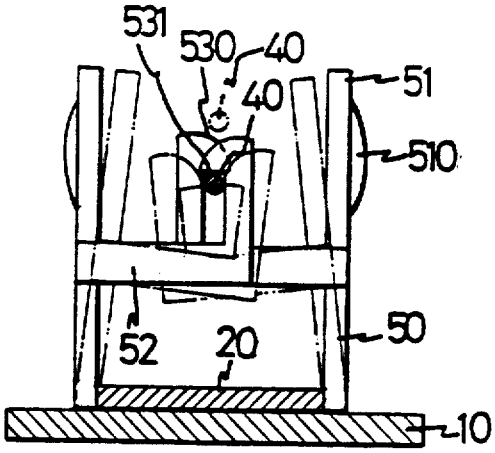
FIG. 2 is a front plain view of the safety pin of FIG. 1 showing that squeezing the two side springs inwards causes the two hooked terminal ends of the two L-shaped pawls to move apart for passing the pin.

Referring to FIGS. 1 and 2, a safety pin is generally comprised of n elongated base plate 20 longitudinally supported on a rectangular board 10. The rectangular board 10 has a bottom edge for attaching a name plate or advertising matter. The base plate 20 has a rear end formed into a vertical pivot bearing 30 for holding a pin 40 by a pivot pin 31. The main feature of the present invention is at the front end of the base plate 20. The front end of the base plate 20 is formed into two symmetrical side springs 50 and a front guard 60. Each side spring 50 has a circular top flange 51 around a convex surface 510 for pressing of the fingers conveniently, and a L-shaped pawl 52 transversely extending from the circular top flange 51 at an inner side. The L-shaped pawl 52 has a hooked terminal end 53 transversely bent backwards. The hooked terminal end 53 has an arched top edge 530 and a straight bottom edge 531. In normal condition, the hooked terminal ends 53 of the L-shaped pawls 52 of the side springs 50 are partly attached together side by side. The front guard 60 comprises a circular convex surface 61 curving outwards at a level corresponding to the height of the straight bottom edge 531.

Referring to FIG. 2 again, pressing the pin 40 downwards causes the point of the pin 40 to move downwards along the arched top edges 530 of the hooked terminal ends 53 of the L-shaped pawls 52 of the two side springs 50, causing the two hooked terminal ends 53 to move part for passing the point of the pin 40. At the same time, the two side springs 50 are caused to deform. Once the point of the pin 40 passes through the gap between the hooked terminal ends 53 of the L-shaped pawls 52, the pressure from the pin 40 is released from the hooked terminal ends 53 of the L-shaped pawls 52, and the material property of the two side springs 50 immediately automatically causes the hooked terminal ends 53 of the L-shaped pawls 52 to return to their former shapes. Therefore, the two hooked terminal ends 53 of the L-shaped pawls 52 are attached together again, permitting the point of the pin 40 to be firmly retained below the straight bottom edges 531 of the two hooked terminal ends 53 and protected by the circular convex surface 61 of the front guard 60. Releasing the pin 40 from the hooked terminal ends 53 of the L-shaped pawls 52 is also easy. Squeezing the circular top flanges 51 of the two side springs 50 inwards causes the two side springs 50 to deform, and therefore, the two hooked terminal ends 53 of the L-shaped pawls 52 are forced apart for passing the pin 40 through the gap therebetween.

Figure 3:
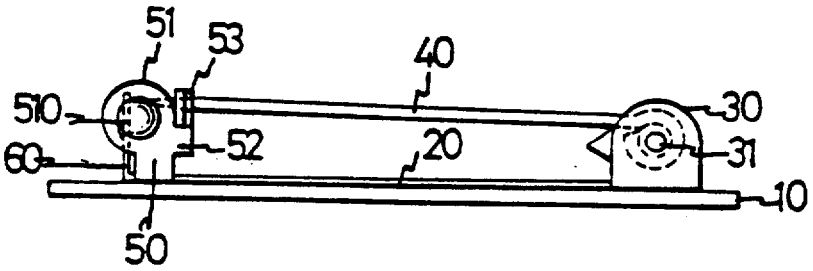
FIG. 3 is a side plain view of the safety pin of FIG. 1 showing that the pin has been locked.
Figure 5:
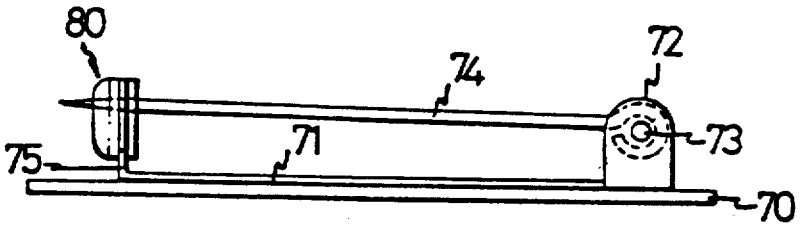
FIG. 5 is a side plain view of the prior art safety pin of FIG. 4.

Referring to FIG. 3, when the pin 40 is locked by the hooked terminal ends 53 of the L-shaped pawls 52, the point of the pin 40 is protected by the circular convex surface 61 of the front guard 60 to prevent piercing the skin.

What is claimed is:

1. A safety pin comprised of an elongated base plate longitudinally supported on a rectangular board, said base plate having a rear end formed into a vertical pivot bearing for pivoting a pin and a front end formed into a vertical pin holder for releasably locking the point of said pin, and characterized in that said pin holder comprises two symmetrical side springs at two opposite sides for releasably locking the point of said pin and a front guard at a front end thereof for protecting the point of said pin, said side springs each having a circular top flange around a convex surface for pressing of the fingers, and an L-shaped pawl transversely extending from said circular top flange at an inner side, said L-shaped pawl having a hooked terminal end transversely bent backwards, the hooked terminal end of the L-shaped pawl of one side spring being releasably retained with the hooked terminal end of the L-shaped pawl of the other side spring for locking the point of said pin.

2. The safety pin of claim 1, wherein squeezing the circular top flanges of said two side springs inwards causes the two hooked terminal ends of the L-shaped pawls of said two side springs to move apart for passing the point of said pin; releasing the pressure from said two side springs causes the two hooked terminal ends of the L-shaped pawls of said two side springs to retain together in locking up the point of said pin.

3. The safety pin of claim 1 or 2, wherein the hooked terminal end of the L-shaped pawl of either side spring has an arched top edge for moving the point of said pin into the space defined between said two side springs, and a straight bottom edge for retaining the point of said pin.

* * * * *